US007320629B2

(12) United States Patent
Okuyama

(10) Patent No.: US 7,320,629 B2
(45) Date of Patent: Jan. 22, 2008

(54) STEERING DEVICE FOR SMALL WATERCRAFT

(75) Inventor: Takashi Okuyama, Shizuoka-ken (JP)

(73) Assignee: Yamaha Marine Kabushiki Kaisha, Shizouka (JP)

( * ) Notice: Subject to any disclaimer, the term of this patent is extended or adjusted under 35 U.S.C. 154(b) by 35 days.

(21) Appl. No.: 11/155,757

(22) Filed: Jun. 17, 2005

(65) Prior Publication Data

US 2005/0282447 A1 Dec. 22, 2005

(30) Foreign Application Priority Data

Jun. 18, 2004 (JP) ..... 2004-180495

(51) Int. Cl.

| | |
|---|---|
| ***B63H 5/20*** | (2006.01) |
| *B63H 5/125* | (2006.01) |
| *B63H 20/08* | (2006.01) |
| *B63H 25/10* | (2006.01) |
| *B63H 25/22* | (2006.01) |

(52) U.S. Cl. ..... 440/53; 440/61 A; 440/61 B; 440/61 C; 440/61 S; 440/63; 114/144 R; 114/150

(58) Field of Classification Search ..... 440/53, 440/61 A, 61 B, 61 C, 61 S, 63, 58–60; 114/144 R, 150; 701/1

See application file for complete search history.

(56) References Cited

U.S. PATENT DOCUMENTS

| | | | | |
|---|---|---|---|---|
| 2,215,003 | A * | 9/1940 | Johnson | 244/2 |
| 2,224,357 | A * | 12/1940 | Pecker | 416/148 |
| 3,084,657 | A | 4/1963 | Kiekhaefer | |
| 3,233,691 | A * | 2/1966 | De Biasi | 180/6.48 |
| 3,310,021 | A | 3/1967 | Shimanckas | |
| 3,349,744 | A | 10/1967 | Mercier et al. | |
| 4,120,258 | A | 10/1978 | Spurgin | |
| 4,220,111 | A * | 9/1980 | Krautkremer et al. | 440/53 |
| 4,500,298 | A | 2/1985 | Hall et al. | |
| 4,519,335 | A * | 5/1985 | Krautkremer et al. | 114/144 R |
| 4,637,802 | A | 1/1987 | Taguchi et al. | |
| 4,787,867 | A | 11/1988 | Takeuchi et al. | |

(Continued)

FOREIGN PATENT DOCUMENTS

| | | |
|---|---|---|
| JP | 62-166193 | 7/1987 |

(Continued)

OTHER PUBLICATIONS

Co-Pending U.S. Appl. No. 11/384,616, filed Mar. 20, 2006. Title: Steering Control System for Boat.

(Continued)

*Primary Examiner*—Jesus Sotelo
*Assistant Examiner*—Daniel V Venne
(74) *Attorney, Agent, or Firm*—Knobbe, Martens, Olson & Bear, LLP

(57) ABSTRACT

In a steering device for a small watercraft that has at least two outboard motors which propulsive directions and propulsive forces are individually controllable. The steering device can have a steering wheel that can be inclined relative to an axis of a steering shaft in any directions including a fore to aft direction and a transverse direction. A control unit that controls shift units and throttle units of the outboard motors so that a hull moves toward a side that is directed by the inclination of the steering wheel.

7 Claims, 6 Drawing Sheets

U.S. PATENT DOCUMENTS

| | | | | |
|---|---|---|---|---|
| 4,872,857 | A | 10/1989 | Newman et al. | |
| 4,908,766 | A | 3/1990 | Takeuchi | |
| 4,909,765 | A | 3/1990 | Riske et al. | |
| 5,029,547 | A | 7/1991 | Novey | |
| 5,031,562 | A | 7/1991 | Nakase et al. | |
| 5,231,888 | A | 8/1993 | Katahira | |
| 5,235,927 | A | 8/1993 | Singh et al. | |
| 5,244,426 | A | 9/1993 | Miyashita et al. | |
| 5,253,604 | A | 10/1993 | Bohlin | |
| 5,361,024 | A | 11/1994 | Wisner et al. | |
| 5,370,564 | A | 12/1994 | Fujimoto et al. | |
| 5,533,935 | A * | 7/1996 | Kast | 472/130 |
| 5,800,223 | A | 9/1998 | Iriono et al. | |
| 5,997,370 | A | 12/1999 | Fetchko et al. | |
| 6,079,513 | A | 6/2000 | Nishizaki et al. | |
| 6,230,642 | B1 | 5/2001 | McKenney et al. | |
| 6,234,853 | B1 * | 5/2001 | Lanyi et al. | 440/53 |
| 6,273,771 | B1 | 8/2001 | Buckley et al. | |
| 6,402,577 | B1 | 6/2002 | Treinen et al. | |
| 6,405,669 | B2 | 6/2002 | Rheault et al. | |
| 6,471,556 | B1 | 10/2002 | Yamashita et al. | |
| 6,511,354 | B1 * | 1/2003 | Gonring et al. | 440/87 |
| 6,535,806 | B2 | 3/2003 | Millsap et al. | |
| 6,561,860 | B2 | 5/2003 | Colyvas | |
| 6,655,490 | B2 | 12/2003 | Andonian et al. | |
| 6,671,588 | B2 | 12/2003 | Otake et al. | |
| 6,678,596 | B2 | 1/2004 | Husain et al. | |
| 6,843,195 | B2 | 1/2005 | Watabe et al. | |
| 6,892,661 | B2 | 5/2005 | Kishi et al. | |
| 6,892,662 | B2 | 5/2005 | Watanabe et al. | |
| 7,063,030 | B2 | 6/2006 | Mizutani | |
| 2003/0150366 | A1 | 8/2003 | Kaufmann et al. | |
| 2003/0224670 | A1 | 12/2003 | Takada et al. | |
| 2003/0224672 | A1 | 12/2003 | Takada et al. | |
| 2004/0007644 | A1 * | 1/2004 | Phelps et al. | 244/17.11 |
| 2004/0031429 | A1 | 2/2004 | Kaufmann et al. | |
| 2004/0121665 | A1 | 6/2004 | Mizuguchi et al. | |
| 2004/0139902 | A1 | 7/2004 | Takada et al. | |
| 2004/0139903 | A1 | 7/2004 | Watabe et al. | |
| 2005/0118894 | A1 | 6/2005 | Kawanishi | |
| 2005/0170712 | A1 | 8/2005 | Okuyama | |
| 2005/0170713 | A1 | 8/2005 | Okuyama | |
| 2005/0199167 | A1 | 9/2005 | Mizutani | |
| 2005/0199168 | A1 | 9/2005 | Mizutani | |
| 2005/0199169 | A1 | 9/2005 | Mizutani | |
| 2005/0215131 | A1 | 9/2005 | Oguma et al. | |

FOREIGN PATENT DOCUMENTS

| | | |
|---|---|---|
| JP | 01-314695 | 12/1989 |
| JP | 02-179597 | 7/1990 |
| JP | 02-227395 | 9/1990 |
| JP | 03-148395 | 6/1991 |
| JP | 04-038297 | 2/1992 |
| JP | B-HEI 6-33077 | 5/1994 |
| JP | 2739208 B2 | 1/1998 |
| JP | 10/226346 | 8/1998 |
| JP | A-HEI 10-310074 | 11/1998 |
| JP | 2959044 B2 | 7/1999 |
| JP | 2000-318691 | 11/2000 |
| JP | 2003-313398 | 11/2000 |
| JP | 3232032 | 9/2001 |
| JP | A-2002-331948 | 11/2002 |
| JP | A-2004-155282 | 6/2004 |

OTHER PUBLICATIONS

Co-Pending U.S. Appl. No. 11/354,491, filed Feb. 15, 2006. Title: Steering Control System for Boat.

Co-Pending U.S. Appl. No. 11/588,060, filed Oct. 25, 2006. Inventor: Mizutani. (submitted herewith) Title: Control Unit for Multiple Installation of Propulsion Units.

Co-Pending U.S. Appl. No. 11/515,600, filed Sep. 5, 2006. Inventor: Mizutani. (submitted herewith) Title: Steering System for a Small Boat.

Co-Pending U.S. Appl. No. 11/516,151, filed Sep. 5, 2006. Inventor: Mizutani. (submitted herewith) Title: Steering Method and Steering System for Boat.

Co-Pending U.S. Appl. No. 11/593,393, filed Nov. 6, 2006. Inventor: Mizutani. (submitted herewith) Title: Electric Type Steering Device for Outboard Motors.

Co-Pending U.S. Appl. No. 11/507,399, filed Aug. 21, 2006. Now published as US2007-0049139A1. (submitted herewith). Title: Action Control Device for Small Boat.

Co-Pending U.S. Appl. No. 11/029,667, filed Jan. 5, 2005. Now published as US2006-0019558A1 (submitted herewith). Title: Steering System for Outboard Drive.

* cited by examiner

STEERING DEVICE FOR SMALL WATERCRAFT

PRIORITY INFORMATION

This application is based on and claims priority under 35 U.S.C. § 119 to Japanese Patent Application No. 2004-180495, filed on Jun. 18, 2004, the entire contents of which is hereby expressly incorporated by reference.

BACKGROUND OF THE INVENTION

1. Field of the Invention

The present invention relates to a steering device provided for steering a small watercraft that has a plurality of outboard motors which are independently controllable.

2. Description of the Related Art

Some small watercraft utilize an outboard motor that incorporates a propulsion device and that is attached to a rear end of a hull. The outboard motor pivots about a swivel axis to adjust a propulsive direction by a steering operation of an operator so that the hull moves in a desired direction.

Other small watercraft include a plurality of outboard motors which propulsive directions and propulsive forces are independently controllable. Such watercraft have, for example, a pair of outboard motors on a transom board, and the propulsive directions and the propulsive forces of the respective outboard motors are individually controlled. A resultant vector of the propulsive forces determines a moving direction of the hull. For example, the hull can move in the right transverse direction when it approaches or leaves from a pier or the like, or can make an immediate turn at the spot in accordance with the resultant vector.

Conventionally, in order to steer small watercrafts having such multiple outboard motors, an operating device such as a joystick or the like which differs from a steering unit that is used for usual steerage is applied. Such an operating device is disclosed in Japanese Patent Application Nos. JP02-227395A, JP2000-313398A, and U.S. Pat. No. 6,234,853.

However, in order to use the operating device such as the joystick or the like together with the steering unit, a particular space is required for accommodating the operating device. A control mechanism for the operating device is also required. Thus, a construction of the steering device can be complicated.

Further, the operator is compelled to use both of the steering unit and the joystick, and also is compelled to change hands under various steerage conditions. Thus, the steerage can be more for such small watercrafts which are primarily so designed that the steerage is easy for the purpose of leisure or the like. That is, the combination of the steering unit and the operating device is inconvenient for such small watercrafts.

SUMMARY OF THE INVENTION

When the present steering device is used under the conventional circumstances discussed above, it can provide a steering device for a small watercraft that can be operated to move a hull of the watercraft in any direction such as in the right transverse direction, only with a steering unit.

Thus, in accordance with an embodiment, a steering device for a small watercraft comprising at least two outboard motors. The steering device comprises a steering unit configured to be rotatable about a steering axis and tiltable relative the steering axis. A control unit can be configured to individually control propulsive directions and propulsive forces of each of the outboard motors. Additionally, the control unit can be configured to control shift units and throttle units of each of the outboard motors so that a hull of the watercraft moves toward a side of the hull in accordance with a tilting angle of the steering unit.

In accordance with another embodiment, a small watercraft comprises a hull having a longitudinal axis. At least two outboard motors mounted at a rear end of the hull. A steering system comprising a steering wheel configured to be rotatable about a steering axis and tiltable relative the steering axis. A control unit can be configured to individually control propulsive directions and propulsive forces of each of the outboard motors so as to move the hull of the watercraft laterally in a direction generally perpendicular to the longitudinal axis in accordance with a tilting angle of the steering unit.

In accordance with yet another embodiment, a small watercraft comprises a hull having a longitudinal axis and at least two outboard motors mounted at a rear end of the hull. A steering system can comprise a steering wheel configured to be rotatable about a steering axis and tiltable relative the steering axis. Additionally, a control unit can include means for controlling propulsive directions and propulsive forces of each of the outboard motors so as to move the hull of the watercraft laterally in a direction generally perpendicular to the longitudinal axis in accordance with a tilting angle of the steering unit.

BRIEF DESCRIPTION OF THE DRAWINGS

The above-mentioned and the other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

Figure 1:
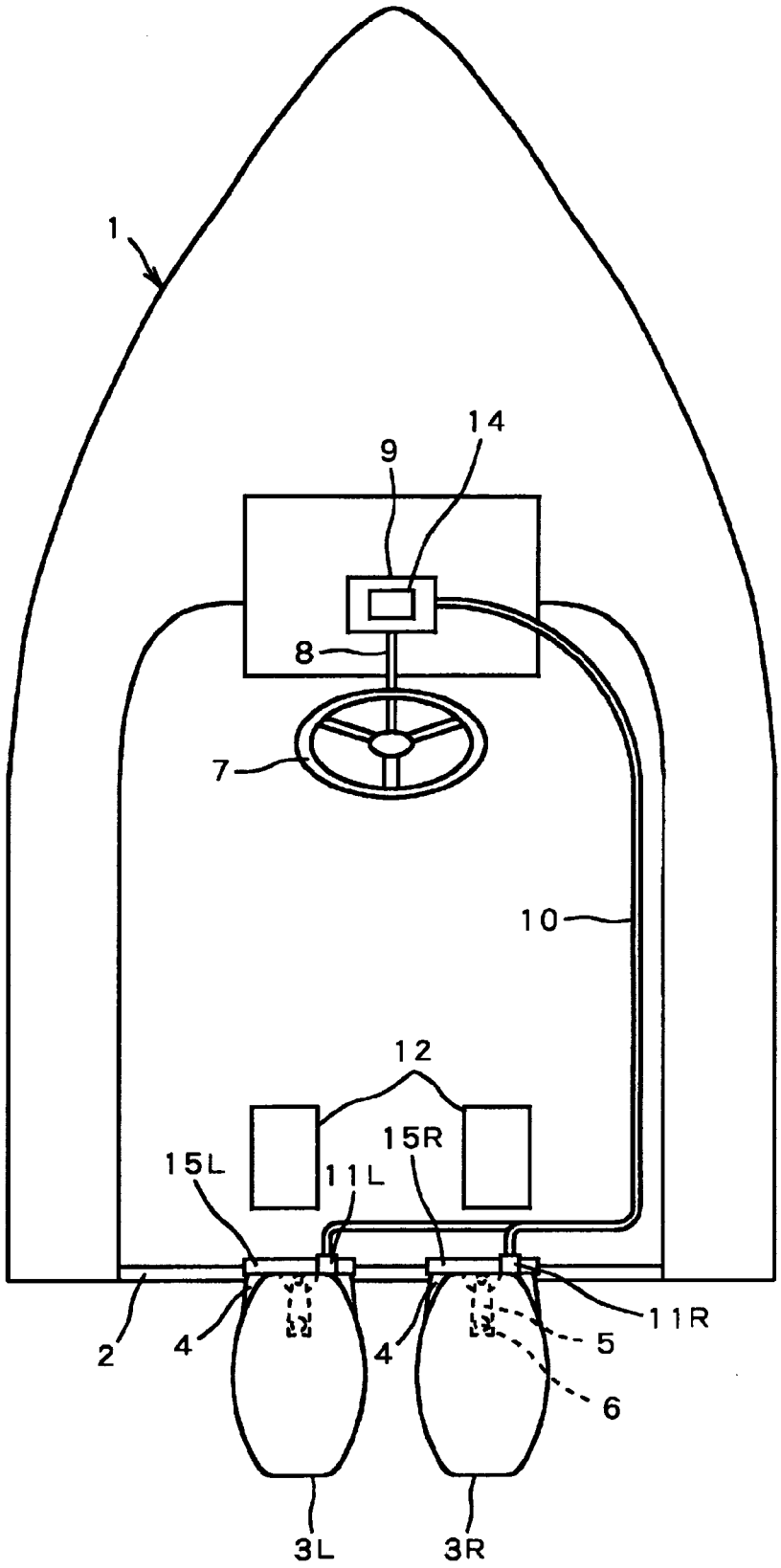
FIG. 1 illustrates a schematic top plan view of a watercraft to which the present inventions can be applied.

FIG. 1 is a schematic top plan view of a small watercraft having a controller for operating plural outboard motors in accordance with an embodiment. The embodiments disclosed herein are described in the context of a small watercraft having multiple outboard motors because the embodiments disclosed herein have particular utility in this context. However, the embodiments and inventions herein can also be applied to other boats having other types of propulsion units as well as other types of vehicles.

As used herein, the terms "front," "rear," "left," "right," "up" and "down," correspond to the direction assumed by a driver of the watercraft.

A pair of outboard motors 3R, 3L, both of which have the same construction, can be mounted on a transom board 2 of a hull 1 of the watercraft. Each outboard motor 3R, 3L can be attached to the transom board 2 via a clamping bracket 4, and can be pivotable about an axis of the swivel shaft 6.

A steering bracket 5 can be affixed to a top end of each swivel shaft 6. A steering drive unit 15R, 15L can be coupled with an end of each steering bracket 5. The steering drive unit 15R, 15L can be formed with, for example, a direct drive motor (DD motor) and a ball screw (not shown), although other configurations and components can also be used.

The DD motor can be configured to move transversely relative to a longitudinal axis of the hull 1 along each ball screw so that the steering bracket coupled with the DD motor pivots about the axis of the swivel shaft 6. Thus, as the respective DD motors operate, a mount angle of each outboard motor 3R, 3L changes, and thus the propulsive direction of the watercraft is adjusted.

A steering wheel 7 can be provided at a cockpit of the hull 1. The steering wheel 7 can be configured to rotate about an axis of a steering shaft 8. Additionally, further advantages can be achieved by configuring the steering wheel 7 so as to be omnidirectionally inclinable relative to the axis of the steering shaft 8, e.g., in other words, tiltable in any directions relative to the shaft 8 including a fore to aft direction and a transverse direction.

Figure 2:
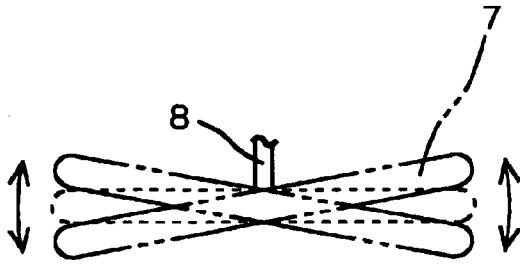
FIG. 2 is a top plan view of a steering wheel of FIG. 1, showing exemplary movements thereof.
Figure 3:
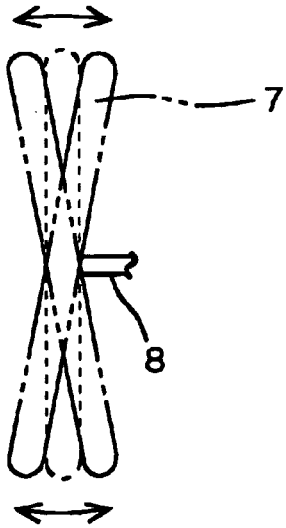
FIG. 3 is a side elevational view of the steering wheel of FIG. 1, showing additional exemplary movements thereof.
Figure 4:
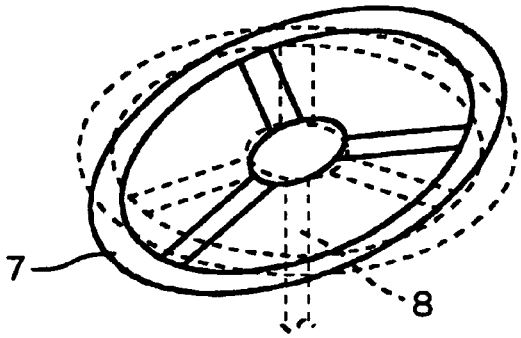
FIG. 4 is a perspective view of the steering wheel of FIG. 1, showing the exemplary movements thereof.

FIGS. 2-4 are explanatory views illustrating movements of the steering wheel 7 that can be utilized with at least some of the embodiments disclosed herein. FIG. 2 is a top plan view of the steering wheel 7 and illustrates transverse tilting of the steering wheel 7. In other words, the steering wheel can be tilted transversely by pushing and/or pulling on the left and right sides of the steering wheel. In yet other words, the steering wheel 7 can be pivoted about a generally vertical axis (not shown).

FIG. 3 is a side elevational view of the steering wheel 7, as viewed from the right hand side, illustrating vertical tilting of the steering wheel 7. In other words, the steering wheel can be tilted in the fore and aft direction by pushing and/or pulling on the upper and lower sides of the steering wheel 7. In yet other words, the steering wheel 7 can be pivoted about a generally horizontal axis (not shown) that extends laterally across the watercraft.

FIG. 4 is a perspective view of the steering wheel 7, illustrating that, in some embodiments, the steering wheel 7 can be configured to incline in any direction relative to the axis of the steering shaft 8.

A steering amount detecting unit 9 (FIG. 5) can be configured to detect a steering amount corresponding to a rotation of the steering wheel 7 about the axis of the steering shaft 8 and an angle of inclination of the steering wheel 7 relative to the axis via the steering shaft 8. The steering amount detecting unit 9 can include an Electronic Control Unit (ECU 14) for the steering operation.

The ECU 14 can be configured to send the detected steering amount to controllers 11R, 11L of the respective outboard motors 3R, 3L through an electric cable 10 as a steering signal. The controllers 11R, 11L can be configured to drive the steering drive units 15R, 15L, respectively, based upon the steering signals to rotate the outboard motors 3R, 3L about the axes of the respective swivel shafts 6. That is, the controllers 11R, 11L can be configured to independently control propulsive directions of the respective outboard motors 3R, 3L.

Each outboard motor 3R, 3L can have an electronically operated throttle unit 33L, 33R and an electrically powered shift unit 34L, 34R. Each electronic throttle unit can include an electric motor configured to drive a throttle valve which is equipped in an intake system of an engine of the associated outboard motor 3R, 3L. Each electric shift unit 34L, 34R can be configured to execute shift operations such as shifts between forward and reverse modes. Optionally, the shift units 34L, 34R can include electric means such as an electric motor, other actuators, or the like.

The ECU 14 or the controllers 11R, 11L can be configured to control the electronic throttle unit and the electric shift unit of the engine of the respective outboard motors based upon the detection signals of the steering amounts, as described below in greater detail.

A battery 12 can be mounted inboard of the hull 1 to supply electric power to operation systems of the respective outboard motors 3R, 3L. One battery 12 can be used to power both outboard motors 3R, 3L or two or more batteries 12 can be used to independently power the outboard motors 3R, 3L.

Figure 5:
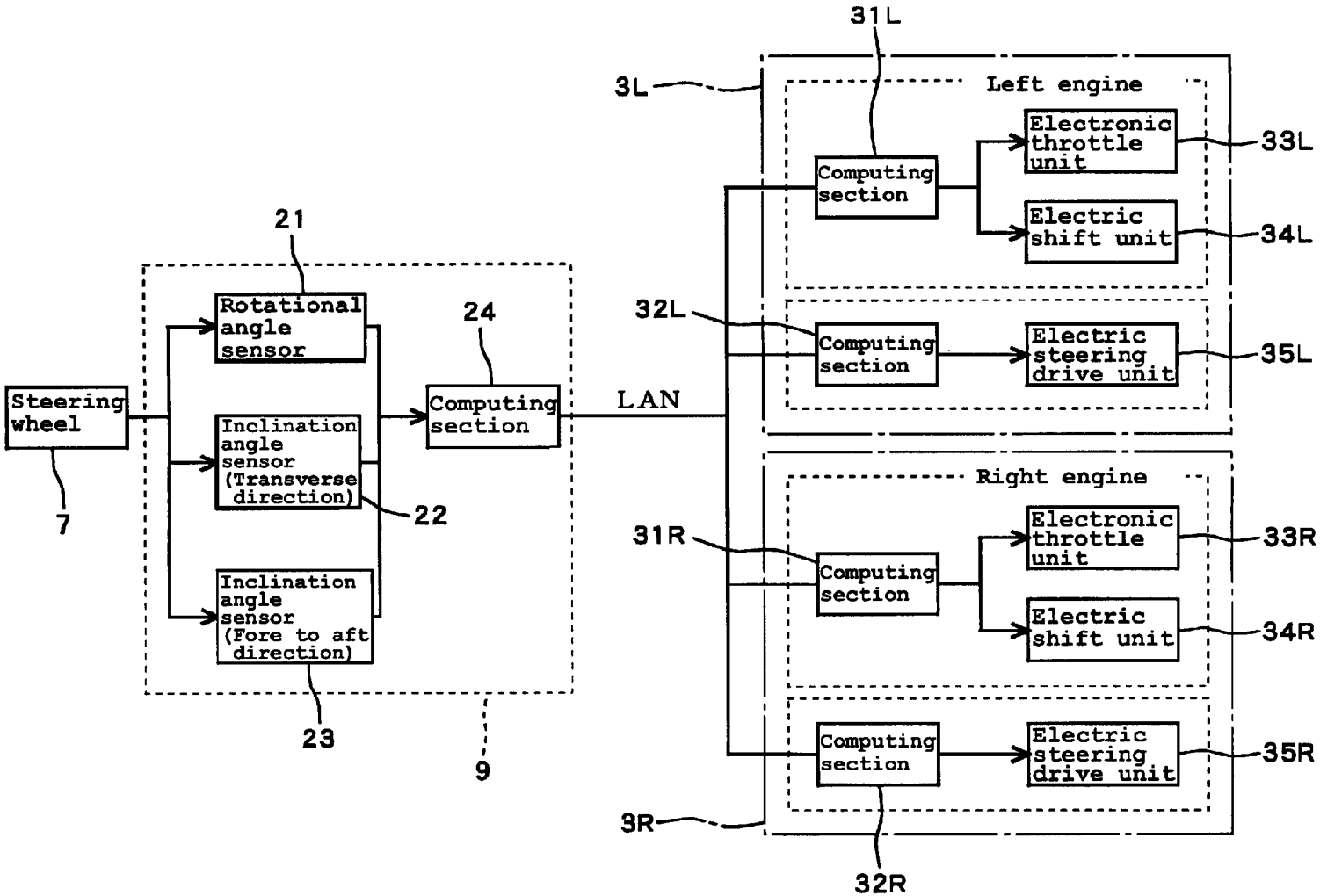
FIG. 5 is a block diagram showing a control system that can be utilized with at least some of the embodiments disclosed herein.

FIG. 5 is a block diagram showing a control system configured for steering the watercraft. The control system can include a rotational angle sensor 21, which can be included in the steering amount detecting unit 9. The rotational angle sensor can be configured to detect a rotational angle of the steering wheel 7 about the axis of the steering shaft 8 (FIG. 1).

If the operator inclines the steering wheel 7 relative to the axis of the steering shaft 8, a transverse direction inclination angle sensor 22 and a fore to aft direction inclination angle sensor 23 can be configured to detect angles of inclination in the transverse direction and the fore to aft direction, respectively. The direction in which the steering handle 7 is inclined is computed from the detection amounts of the respective inclination angle sensors 22, 23. Thus, the direction is specified among 360 degrees, i.e., the omnidirectional range, around the axis of the steering shaft 8.

The rotational angle sensor 21 and the inclination angle sensors 22, 23 can be configured to send respective detection amounts to a computing section 24 as electric signals. The computing section 24 can be configured to process data of the steering amounts (rotational angles and inclination angles) of the steering unit 7.

The computing section 24 can be configured to send the steering amount data of the steering unit 7 processed therein to the respective outboard motors 3R, 3L through, for example, electric cables that form an inboard LAN, or by radio.

A computing section 31R, 31L for the engine control of each outboard motor 3R, 3L can be configured to compute a throttle opening amount that is sufficient to obtain a propulsive force corresponding to the angle of the inclination of the steering wheel 7 and a propulsive direction in the forward or reverse operation corresponding to the direction of inclination. Additionally, the computing sections 31R, 31L can be configured to command an associated electronic throttle unit 33R, 33L and electric shift unit 34R, 34L with the throttle opening and the propulsive direction.

A computing section 32R, 32L for the steering control can be configured to compute a direction of each outboard motor 3R, 3L corresponding to the angle of inclination of the steering wheel 7. Additionally, the computing sections 32R, 32L can be configured to command an associated electrically powered steering drive unit 35R, 35L. As thus described, control units (computing sections 24, 31R, 31L, 32R, 32L) control the propulsive directions and the propulsive forces of the respective outboard motors 3R, 3L in response to the operation of the steering unit 7.

Figure 6:
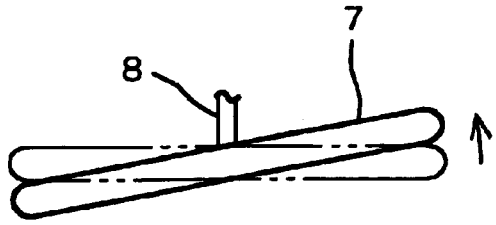
FIG. 6 is a top plan view of the steering wheel, showing an exemplary movement that can be utilized with at least some of the embodiments disclosed herein.
Figure 7:
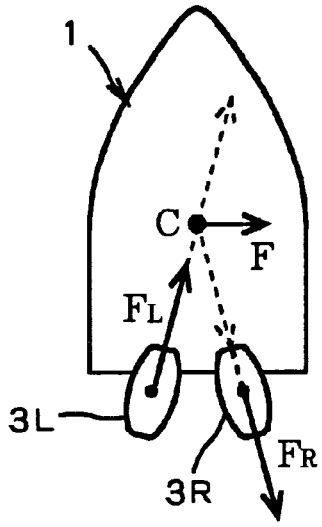
FIG. 7 illustrates a schematic top plan view of the watercraft, showing exemplary propulsive forces generated when the steering wheel is operated as shown in FIG. 6.
Figure 8:
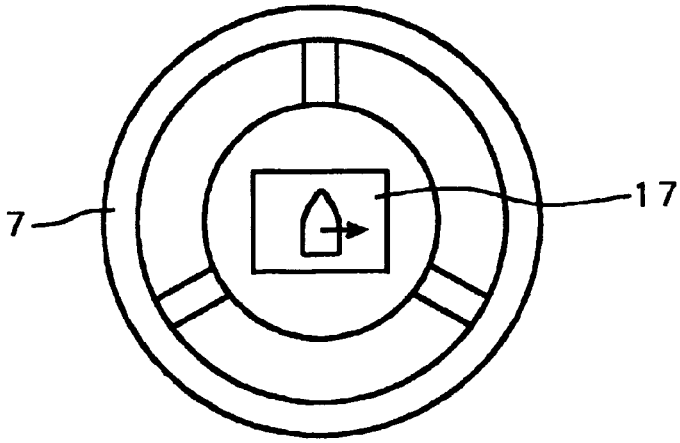
FIG. 8 illustrates a front view of the steering wheel, showing a top surface thereof at a moment when the steering wheel is operated as shown in FIG. 6.

FIGS. 6-8 illustrate exemplary but non-limiting operations of the steering device. FIG. 6 is a top plan view showing a transverse tilting motion of the steering wheel 7. FIG. 7 is a schematic top plan view of the watercraft and illustrating an exemplary but non-limiting transverse movement of the hull 1. FIG. 8 is a front view of the steering wheel 7 during a lateral movement. This exemplary operation is a control for moving the hull in the right transverse direction.

As shown in FIG. 6, an operator can push a portion of the steering wheel 7 on the right hand side so as to incline or tilt it in the right transverse direction. The inclination angle sensor 22 (FIG. 5) detects an angle of the inclination of the steering wheel 7 toward the right hand side in the transverse direction. In response to the detection amount of the inclination angle toward the right hand side, the control unit (computing section 24) drives the respective electric steering drive units 35R, 35L (FIG. 5) such that the respective outboard motors 3R, 3L together form a shape tapered forward as shown in FIG. 7, in accordance with a program that is previously installed.

Under this condition, the electric shift units 34R, 34L are driven to generate a propulsive force FL of the outboard motor 3L on the left hand side directed rightward forward relative to the hull 1, and to generate a propulsive force FR of the outboard motor 3R on the right hand side directed rightward rearward relative to the hull 1. Those propulsive forces FL, FR are controlled such that a resultant vector thereof is equal to a vector F that heads rightward relative to the hull 1 with a central point C as a point of action. Thus, the hull 1 obtains the propulsive force heading transversely rightward and moves rightward in the right transverse direction. The control units (computing section 24 or computing sections 31R, 31L) determine the magnitudes of the propulsive forces FL, FR in accordance with the inclination angle of the steering wheel 7, and control the electronic throttle units 33R, 33L using the propulsive forces FL, FR.

As shown in FIG. 8, a top surface of the steering wheel 7 can include a monitor 17 such as, for example, a liquid crystal display or the like. When the control units control the electronic throttle units 33R, 33L, the monitor 17 shows the moving direction of the hull 1. For instance, the moving direction is indicated by an arrow as shown in FIG. 8, while the magnitude of the propulsive force is roughly indicated by the length of the arrow.

Figure 9:
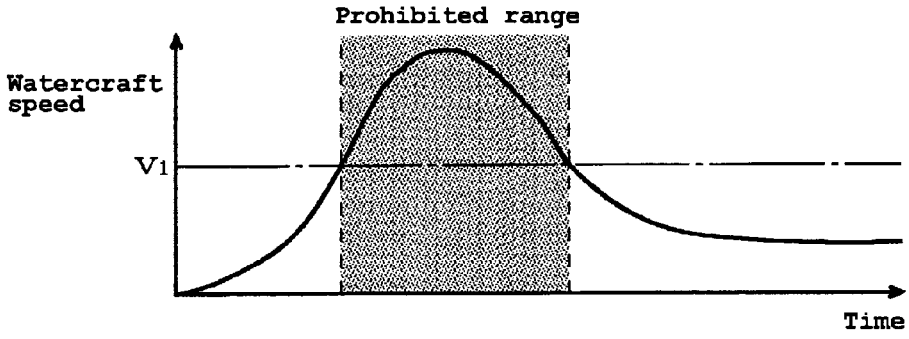
FIG. 9 illustrates a graph showing an operational range limit that can be utilized with at least some of the embodiments disclosed herein.

FIG. 9 is an graph showing exemplary but non-limiting relationships between a speed of the watercraft and the steerage control. In this example, the operator wishes to move the hull 1 in the right (starboard) transverse direction to approach or leave from a pier. Such a movement is not made in a high speed running but in a low speed running.

During high speed running, such as at planing speeds, watercraft operators usually rotate the steering wheel to change a moving direction of the watercraft. Thus, the present steering system can be configured to ignore tilting movements of the steering wheel 7 at elevated watercraft and/or engine speeds.

Accordingly, as shown in FIG. 9, a range where the watercraft speed is higher than a preset speed V1 is used as a prohibited range in which the execution of a control routine that is based upon the inclination angle of the steering wheel is prohibited. For example but without limitation, the control can be programmed such that the computing section 24 of the steering amount detecting unit 9 or either one of the computing sections 31R, 31L, 32R, 32L of the outboard motors 3R, 3L does not recognize the detection amounts of the inclination angle sensors 22, 23 of FIG. 5 even though the steering wheel 7 is inclined in the prohibited range. Alternatively, a switching circuit or unit can be provided to shut off the outputs from the control units in response to the watercraft speed.

In another alternative, a mechanical lock mechanism can be configured to prevent the steering wheel 7 from being inclined. For example, such a lock mechanism can be configured to lock the steering wheel such that it can rotate about the steering shaft axis but not tilt when a speed of the watercraft higher than the predetermined speed V1.

Figure 10:
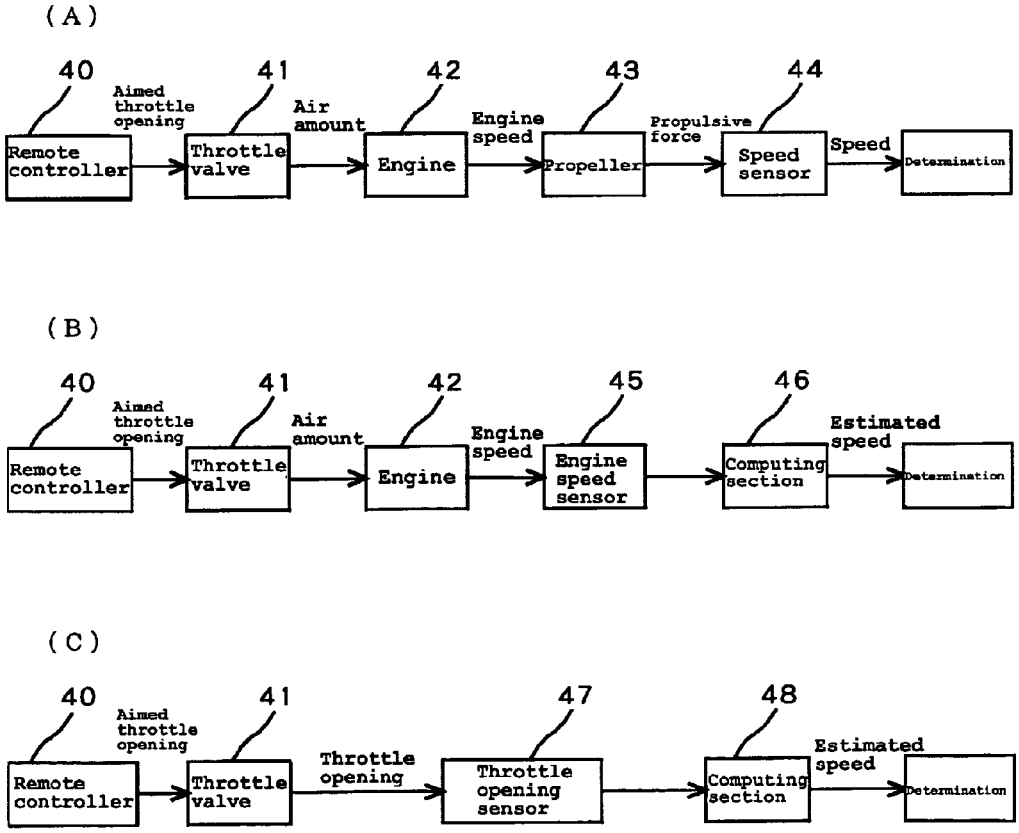
FIG. 10(A) is a block diagram illustrating an exemplary operation for controlling a speed of the watercraft.
FIG. 10(B) is a block diagram illustrating an exemplary modification of the operation for controlling a speed of the watercraft of FIG. 10(A).
FIG. 10(C) is a block diagram illustrating another exemplary modification of the operation for controlling a speed of the watercraft of FIG. 10(A).

FIG. 10 includes explanatory block diagrams illustrating methods that can be used for detecting the speed of the watercraft. For example, in order to determine whether the watercraft speed is in the prohibited range or not, the watercraft speed can be detected by a speed sensor as shown in FIG. 10(A), or the watercraft speed can be estimated from the engine speed or the throttle opening as shown in FIG. 10(B) or FIG. 10(C).

FIG. 10(A) illustrates a method in which the speed sensor detects the watercraft speed. Normally, shift levers (remote control levers) are disposed next to an operator's seat for the respective outboard motors. A shift change between forward and reverse positions together with an open and close control of the throttle valve can be made by operating each remote control lever. With the operation of each remote control lever 40, the throttle valve 41 opens to a target throttle opening to supply air to the engine 42.

The rotation of the engine 42 is transmitted to a propeller 43 to generate the propulsive force. The watercraft runs in a speed corresponding to a magnitude of the propulsive force. The speed sensor detects the watercraft speed. The speed sensor 44 detects positions of the watercraft, for example, by the GPS signal and computes a moving speed from the position information. In some embodiments, the speed sensor can also comprise a pitot tube type sensor or a paddle wheel type sensor.

FIG. 10(B) shows another method in which the watercraft speed is estimated from the engine speed. It is well known in the art that watercraft speed generally corresponds to the engine speed. This is because that, in general, an engine of a watercraft drives a propeller by a single stage reduction gear without using a multiple stage geared shift mechanism, and thus the engine speed can correspond to the speed in every situation except for an acceleration or deceleration situation in which a load fluctuation is large. Accordingly, an engine speed sensor 45 can replace the speed sensor 44. A computing section 46 computes a watercraft speed corresponding to an engine speed. That is, the watercraft speed can be estimated.

Because the watercraft speed can be estimated with the accuracy that is sufficient for practical use according to the method, no additional expensive sensor is necessary, which can thus lower the manufacturing costs. Additionally, control mechanisms, wiring structures and so forth can be more simplified. In addition, every normal engine inevitably incorporates an engine speed sensor because the engine speed sensor is highly useful for fuel control and ignition control. The watercraft speed thus can be obtained only using such an existing engine speed sensor without requiring new devices or the like.

FIG. 10(C) shows a further method in which the watercraft speed is estimated from the throttle opening detected by the throttle opening sensor 47. In this method, similarly to the method shown in FIG. 10(B), the watercraft speed can corresponds to the throttle opening. A computing section 48 thus computes a watercraft speed based upon a detection amount of the throttle opening sensor 47. The watercraft speed can be estimated with the accuracy that is sufficient for practical use. Also, the throttle opening sensor is highly useful for the control of engine operation. Thus, the watercraft speed can be obtained without requiring new devices.

Figure 11:
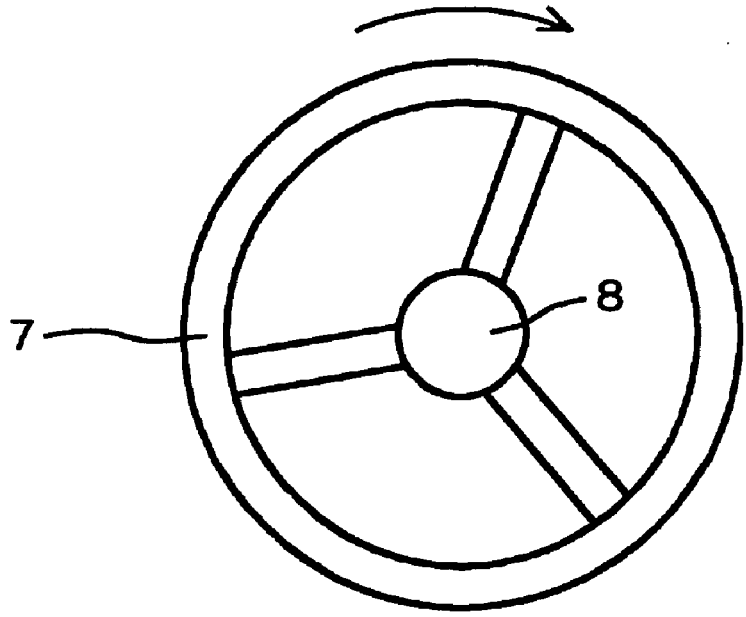
FIG. 11 illustrates a front view of the steering wheel, showing another exemplary operation thereof.
Figure 12:
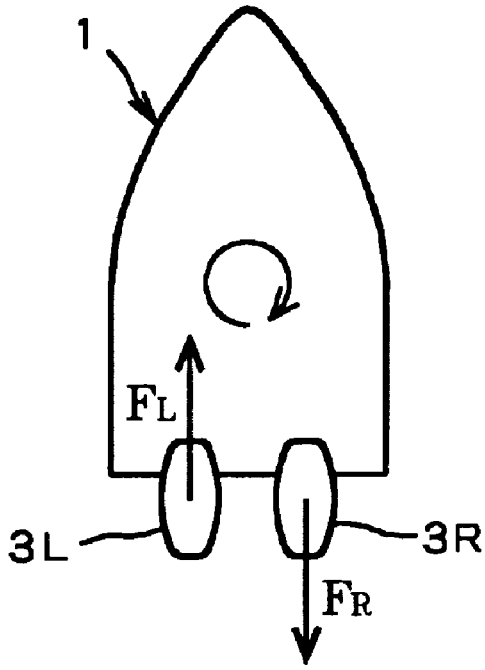
FIG. 12 is a schematic top plan view of the watercraft showing exemplary propulsive forces when the steering wheel is operated as shown in FIG. 11.

FIGS. 11 and 12 illustrate another exemplary operation of the steering device. This is an example of the control that is the so-called immediate turn at the spot in which the hull turns immediately at the spot without advancing. In other words, the hull 1 is rotated about an axis that extends through the hull. This operation also can be practiced on that particular and limited occasion in which the watercraft speed is slower than the preset speed. In other words, at least one of the computing sections 31R, 31L, 32R, 32L, 24 can be configured so as to allow this operation only if the watercraft speed is below a predetermined speed, such as the speed V1 or another predetermined speed lower than V1.

As shown in FIG. 11, the operator can rotate the steering wheel 7 clockwise about the axis of the steering shaft 8. At this moment, as shown in FIG. 12, the outboard motors 3R, 3L generate a rearward propulsive force FR and a forward propulsive force FL, respectively. The hull 1 makes the immediate turn at the spot because the propulsive forces of the respective outboard motors 3R, 3L are parallel to each other and face in the opposite directions with each other. That is, if the watercraft speed obtained in any one of the methods described using FIG. 10 is slower than the preset speed, the operations of the respective outboard motors 3R, 3L are controlled by a program routine that is provided for the immediate turn at the spot that is previously installed in the respective control units based upon the rotational angle of the steering wheel 7 that is detected by the rotational angle sensor 21 of FIG. 5.

Preferably, the operation of the steering wheel is programmed to make the immediate turn at the spot, although the operation of the steering wheel on that occasion makes the same rotation about the axis of the steering shaft as that made in the normal steerage. Normally, the immediate turn at the spot is made in an extreme low speed of the watercraft. The normal steering mode thus can be changed to the steering mode of the immediate turn at the spot without causing any problems because of such a slow speed. Alternatively, a release button or the like can be provided to change the steering mode of the immediate turn at the spot to the normal steering mode even under the slow speed movement condition. In another alternative, the speed limit for the steering mode of the immediate turn at the spot can be changeable within a preset range with a simple operation.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A steering device for a small watercraft comprising at least two outboard motors, the steering device comprising a steering unit configured to be rotatable about a steering axis and tiltable relative to the steering axis, a control unit configured to individually control propulsive directions and propulsive forces of each of the outboard motors, the control unit being configured to control shift units and throttle units of each of the outboard motors so that a hull of the watercraft moves toward a side of the hull in accordance with a tilting angle of the steering unit, wherein the control unit is configured to control the respective outboard motors in response to the tilting angle only under a condition that a speed of the watercraft is slower than a preset speed.

2. The steering device for a small watercraft according to claim 1, wherein the control unit is configured to control propulsive force in response to an angle of inclination of the steering unit.

3. The steering device for a small watercraft according to claim 1, wherein the control unit is configured to control the respective outboard motors so that the hull makes an immediate turn on a spot with an operation of the steering unit when the steering unit is rotated about the steering axis while the watercraft moves in a speed slower than a preset speed.

4. The steering device for a small watercraft according to claim 1, wherein the speed of the watercraft is an estimated speed that is computed from an engine speed or a throttle opening.

5. A steering device for a small watercraft comprising at least two outboard motors, the steering device comprising a steering unit configured to be rotatable about a steering axis and tiltable relative to the steering axis, a control unit configured to individually control propulsive directions and propulsive forces of each of the outboard motors, the control unit being configured to control shift units and throttle units of each of the outboard motors so that a hull of the watercraft moves toward a side of the hull in accordance with a tilting angle of the steering unit, wherein the control unit is configured to control the respective outboard motors so that the hull makes an immediate turn on a spot with an operation of the steering unit when the steering unit is rotated about the steering axis while the watercraft moves in a speed slower than a preset speed, and wherein the speed of the watercraft is an estimated speed that is computed from an engine speed or a throttle opening.

6. A steering device for a small watercraft comprising at least two outboard motors, the steering device comprising a steering unit configured to be rotatable about a steering axis and tiltable relative to the steering axis, a control unit configured to individually control propulsive directions and propulsive forces of each of the outboard motors, the control unit being configured to control shift units and throttle units of each of the outboard motors so that a hull of the watercraft moves toward a side of the hull in accordance with a tilting angle of the steering unit, wherein the steering unit has a display monitor, and a moving direction of the hull is shown on the display monitor.

7. The steering device for a small watercraft according to claim 6, wherein a magnitude of the propulsive force generated when the hull moves is shown on the display monitor.

* * * * *